United States Patent [19]

Paterson et al.

[11] 4,194,633

[45] Mar. 25, 1980

[54] ADJUSTABLE CONVEYOR

[75] Inventors: Malcolm M. Paterson, Lee, N.H.; William J. Paxson; Charles W. Christensen, both of Cedar Rapids, Iowa

[73] Assignee: Raytheon Company, Lexington, Mass.

[21] Appl. No.: 936,412

[22] Filed: Aug. 24, 1978

Related U.S. Application Data

[63] Continuation of Ser. No. 832,719, Sep. 12, 1977, abandoned.

[51] Int. Cl.[2] ..... B07B 4/06

[52] U.S. Cl. ..... 209/152; 198/586; 198/862

[58] Field of Search ..... 198/862, 586, 312; 214/38 B, 38 BA, 38 BB; 209/136, 137, 147, 152, 221, 224, 473, 451, 452, 482

[56] References Cited

U.S. PATENT DOCUMENTS

| | | | |
|---|---|---|---|
| 2,631,715 | 3/1953 | Vickers | 198/312 X |
| 3,664,534 | 5/1972 | Hunter | 198/862 X |
| 3,891,099 | 6/1975 | Smith | 198/862 X |
| 3,970,547 | 7/1976 | Theodore et al. | 209/136 |

*Primary Examiner*—Ralph J. Hill
*Attorney, Agent, or Firm*—John T. Meaney; Joseph D. Pannone; Richard M. Sharkansky

[57] ABSTRACT

A rotary drum air classifier system which includes a conveyor positioned to feed unclassified materials of various densities and weights into one end of a drum, and supporting means for the conveyor having means for moving the conveyor in any of three directions axially, vertically and laterally of the drum's axis so as to position its discharge end in desired position depending upon the density of the mixture of materials being fed into the drum, thereby obtaining maximum efficiency of the classification procedure.

12 Claims, 5 Drawing Figures

ADJUSTABLE CONVEYOR

CROSS-REFERENCE TO RELATED APPLICATION

This is a continuation of co-pending patent application Ser. No. 832,719, filed Sept, 12, 1977 and now abandoned.

BACKGROUND OF THE INVENTION

In known air classification systems unclassified mixed materials may be deposited by a suitable feed conveyor into the lower inlet end of an inclined rotating air classifier drum. As the drum rotates, a stream of air is forcefully directed through the drum and entrains light weight, light density materials which comprise part of the mixture and carries them out the raised discharge end of the drum into a suitable storage area such as a plenum, cyclone or silo. The materials which are too heavy or too dense to be entrained are tumbled by the rotation of the drum and eventually work their way back out the lower inlet end of the drum onto suitable conveyor means which removes them for subsequent processing or storage.

Such air classification systems are becoming popular in municipal waste handling installations where a great variety of materials are mixed together. For example, paper fabric, plastic, glass and wood are mixed with metal which may comprise small items such as coins to large items such as iron castings, for examples. Sometimes the mixture is predominantly comprised of the heavy items and at other times the light items predominate.

When heavy items are predominant, they tend to clog the drum unless the feed rate is reduced since heavy items must work their way gradually down the inclined drum. When light items predominate, separation is difficult unless the velocity of the air stream passing through the drum is increased.

One known attempt to solve this problem has been disclosed in U.S. Pat. No. 3,970,547 which teaches a system wherein the feed conveyor is movable axially within the drum to adjust the longitudinal position within the drum at which the materials are deposited. However, while this has provided some improvement, it has not been entirely successful.

SUMMARY OF THE INVENTION

The above and other objections to and disadvantages of known rotary drum air classifier systems are overcome by the present invention wherein there is employed a feed conveyor means which is adjustable axially of a rotary drum and also adjustable laterally and vertically of the drum. This is accomplished by mounting the conveyor and feed hopper upon a suitable undercarriage which is itself vertially movable and is comprised of portions which are slidable whereby lateral and axial movement are accomplished. Movement of the various adjustable parts of the undercarriage is accomplished by a number of hydraulic actuators or other devices so that adjustments in the three directions are performed independently. In one embodiment the conveyor is preferably fixed to a first section which is movable laterally of the drum upon a second section. A third section carries the first and second sections and is movable axially of the drum together therewith and with the conveyor. The third section forms a part of a vertically adjustable carriage whereby, when such vertical adjustment is effected, it will move up or down together with the first and second sections and the conveyor.

Since the mixture of materials being classified is usually predominantly comprised of either heavy or light materials, the conveyor will rarely be located on the axis of the drum. If the materials comprise predominantly heavy items, the conveyor will preferably be withdrawn toward the inlet end of the drum so as to discharge usually within the first third of its length, and will be preferably located slightly nearer the rising side wall of the drum. This will effectively facilitate the removal of the relatively large amounts of heavy materials.

If the mixture of materials comprises predominantly light items, the conveyor will be positioned preferably farther inwardly of the drum and above the drum's longitudinal axis. This enables the light materials to be more effectively engaged by the air stream as they fall a greater distance from the conveyor toward the bottom of the drum.

BRIEF DESCRIPTION OF THE DRAWINGS

The above and other objectives and advantages of this invention will become apparent from the following description taken in connection with the accompanying drawings wherein.

DESCRIPTION OF THE PREFERRED EMBODIMENTS

Figure 1:
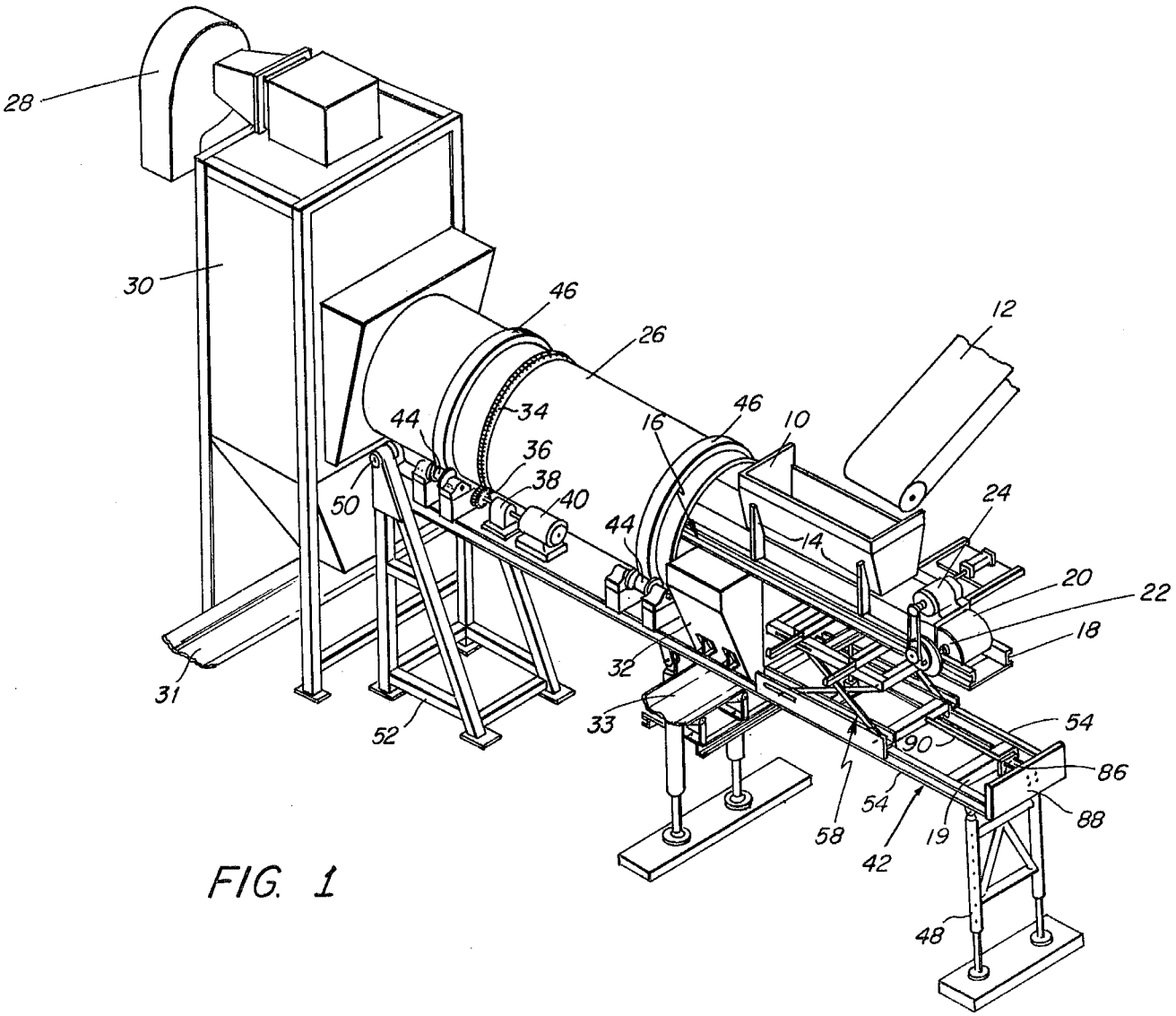
FIG. 1 is an isometric view of a rotary drum air classifier system embodying the invention.

Referring more particularly to the drawings whrein like characters of reference designate like parts throughout the several views, the apparatus shown in FIG. 1 includes a number of cooperating devices arranged to process and separate materials automatically, these pieces of apparatus being parts of a complete waste resource separating and recovery system.

A feed hopper 10 receives unclassified waste or other mixture of materials from one end of an adjacent supply conveyor 12. The hopper 10 is mounted as by brackets 14 on a first frame 16 which comprises a pair of spaced parallel longitudinally extending rails 18 secured together by suitable cross members 19. The hopper 10 is raised sufficiently above the frame 16 to permit a longitudinally extending feed conveyor 20 to be disposed beneath the hopper and preferably between the rails 18. The conveyor 20, as shown in FIG. 1, may be suitably supported on the rails 18 as by mounting its drums 22 on a shaft which is journaled at its opposite ends in the rails 18. A motor 24 with conventional belt and pulley drive mechanism 25 is utilized for moving the conveyor belt in a well-known manner.

The feed conveyor 20 projects into the interior of a horizontally disposed rotary air classifier drum 26 and is adapted to receive mixed materials to be classified from the bottom of the hopper and propel them into the drum. The materials have preferably been shredded to a size not exceeding about twelve inches, and the drum classifier separates the shredded materials in the known fashion of apparatus of this character. The drum 26 is angled at a selected inclination, such as 10°, for example, and air is caused to flow through it at high velocity by means of a fan or blower 28 which may be suitably mounted on a plenum, cyclone or similar collecting chamber 30 into the higher end of which the drum projects.

As raw mixed materials drop from the end of the feed conveyor 20 onto the bottom of the drum wall, the heavy materials in the mixture will be rotated upwardly with the drum to a point where they will fall to a lower point within the drum. Such tumbling action is repeated until eventually the heavy materials fall out of the lower end of the drum through a chute 32 onto another conveyor 33 which will carry them away for further processing or disposal. The light materials will be entrained within the high velocity air stream and will be carried out the upper end of the drum 26 into the collection chamber 30 from which they may be subsequently removed by a conveyor 31 to a remote location for further processing, such as being converted into a refuse derived fuel, for example.

It is to be understood that the feed conveyor 20, which is illustrated herein as a belt-type device, may take other forms such as, for example, a screw feed as disclosed in aforementioned U.S. Pat. No. 3,970,547 which is owned by the same assignee as the present invention.

Figure 2:
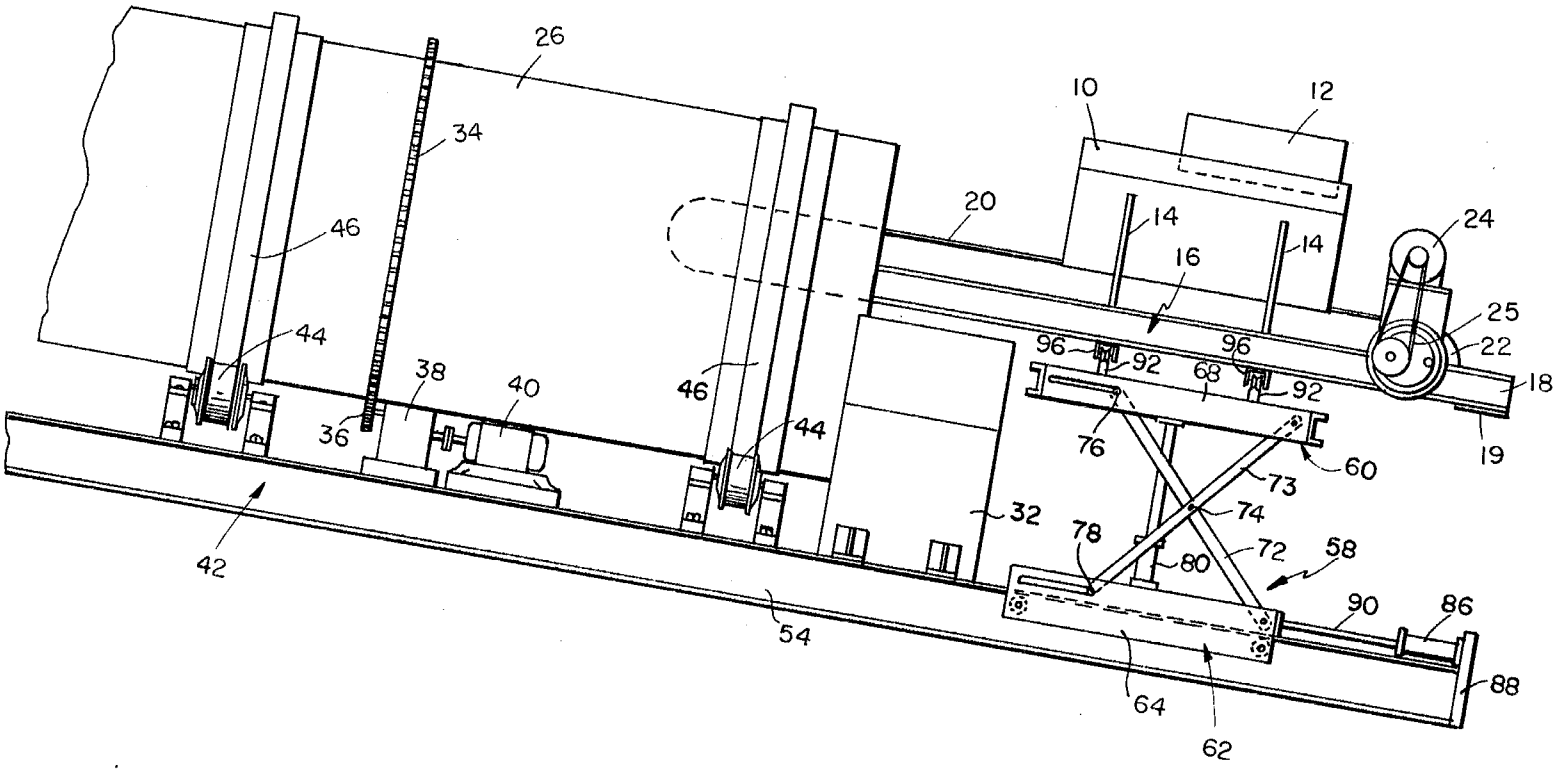
FIG. 2 is a side elevational view of the system shown in FIG. 1.

Any suitable means may be used to rotate the drum 26. In FIGS. 1 and 2 this means comprises a circumferential sprocket wheel 34 which is fixed around the drum at a point midway of its length and which meshes with a small sprocket wheel 36 rotatably mounted on one end of a reduction gear box 38. The gear box 38 is interconnected with a drive motor 40 whereby rotation of the drum is accomplished.

The drum 26 is supported upon a platform 42 by means such as a pair of rollers 44 which each engage a respective restraining ring or collar 46, the rings being fixed to and extending around the circumference of the drum near opposite ends thereof. The rollers 44 have flanges on their sides which engage opposite sides of the respective ring 46 to prevent longitudinal movement of the drum as it is rotated.

The platform 42 is pivotally supported at one end beneath the conveyor by vertically adjustable support means 48 and at its opposite end it is pivotally mounted by a bearing 50 on the upper end of a fixed support 52. The platform 42 and consequently the drum 26, together with the conveyor apparatus may be angled to a selected inclination, such as 10°, for example, by raising or lowering about the axis of the bearing 50.

It will be apparent that variations in the angle of inclination of the drum and variations in the velocity of the air flow through the drum will cause changes in the ratio of lights to heavies during a separation process. However, other factors also must necessarily be considered when attempting to achieve efficient desired classification of the mixed materials.

For example, the predominance of heavy materials in a mixture will sometimes cause the drum to become clogged or otherwise will prevent ready separation of light materials. Regulation of air flow has little effect on most heavy items, and regulation of the drum's angle of inclination may decrease the separation efficiency. Slowing of the feed conveyor to overcome such a problem may cause undesirable backlogging of unclassified materials.

The predominance of light materials in a mixture will sometimes produce unsatisfactory separation since increase of air velocity may cause an undesirable amount of heavies to be entrained and removed with the lights.

The aforementioned Pat. No. 3,970,547 teaches that a conveyor is positioned on the axis of a rotary drum and may be moved axially thereof in order to select the longitudinal position within the drum at which material is deposited. An earlier U.S. Pat. No. 3,804,249, teaches that material should be deposited in the longitudinally central portion of the drum. Neither of these patented apparatus completely solve the problems enumerated above.

In accordance with the present invention the conveyor is mounted for universal, that is, for axial, lateral and vertical adjustment with respect to the axis of the drum, and when properly adjusted the conveyor will feed mixed waste materials into the drum at a location which achieves a selected ratio of lights to heavies separation without requiring variation in angle of drum inclination or in velocity of air flow. Such adjustment of the conveyor allows mixed materials to be fed into the drum at an optimum location depending upon the predominance of light or heavy materials in the mixture being classified.

It has been found that when a mixture is comprised predominantly of heavy materials, the best separation is achieved when the discharge end of the conveyor is located relatively near the inlet end of the drum, below the drum's axis and somewhat nearer the rising side wall of the drum. In this position the heavy items will have a short path to follow in tumbling down and out the drum, thus preventing clogging which otherwise might occur. Furthermore, the heavy items are more quickly lifted by the rising side wall of the drum than would occur if the conveyor was positioned nearer the falling side wall. This also aids in the prevention of clogging.

When the mixture is comprised predominantly of light items, it has been found that the conveyor will be preferably located above the axis of the drum at almost any point along the length of the drum. This will enable the air stream to make most effective contact with the mass of light materials, entraining them and efficiently conducting them into the collection chamber.

Figure 3:
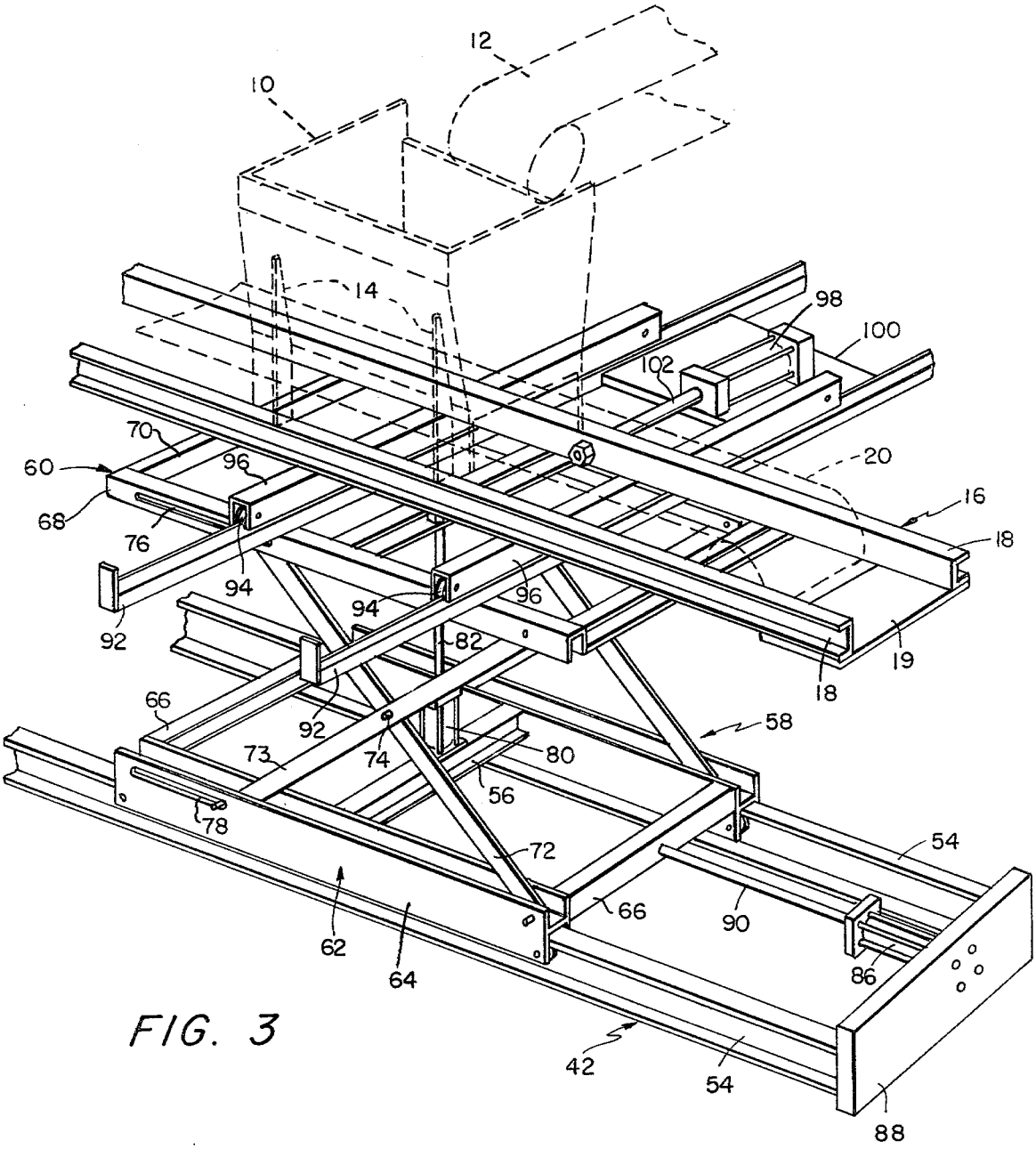
FIG. 3 is an enlarged perspective view of the adjustable conveyor-supporting structure.

The platform 42 which carries the conveyor supporting and adjusting mechanism includes a pair of spaced base rails 54 which are interconnected by cross members 56 as best shown in FIG. 3. An adjustable carriage 58 is mounted on the platform and includes an upper and a lower frame 60 and 62 respectively. Lower frame 62 comprises a pair of spaced parallel longitudinally extending I-beams 64 interconnected by cross members 66. The upper frame 60 similarly comprises a pair of spaced parallel longitudinally extending channel members 68 interconnected by cross members 70.

Extending upwardly between the frames 60 and 62 on either side thereof is a pair of crossed arms 72 and 73 which are pivotally mounted at their crossover points on an interconnecting shaft 74. The I-beams 64 are positioned with channels therein opening upwardly, while the channels in upper channel members 68 open downwardly. The lower end of arms 72 are pivotally mounted within the channel near one end of one of the lower members 64 and has its upper end slidably mounted as by a pin and slot connection 76 in the channel near the opposite end of the upper member 68. The other arm 73 is similarly mounted with its upper end pivoted to one end of upper member 68 and its lower end slidably connected by pin and slot connection 78 to the opposite end of lower member 64.

Thus, the upper frame 60 may move up and down toward and away from the lower frame 62 and the arms 72–73 will perform a scissoring action to retain the frames in the desired respective relations. Such movement of upper frame 60 may be accomplished by any suitable means such as a hydraulic piston 80 which is mounted on a cross member 56 of the lower frame 62 and has its piston rod 82 connected to a cross member 70 of the upper frame 60. The piston 80 may be actuated by any suitable means (not shown) to raise and lower the upper frame 60.

Figure 4:
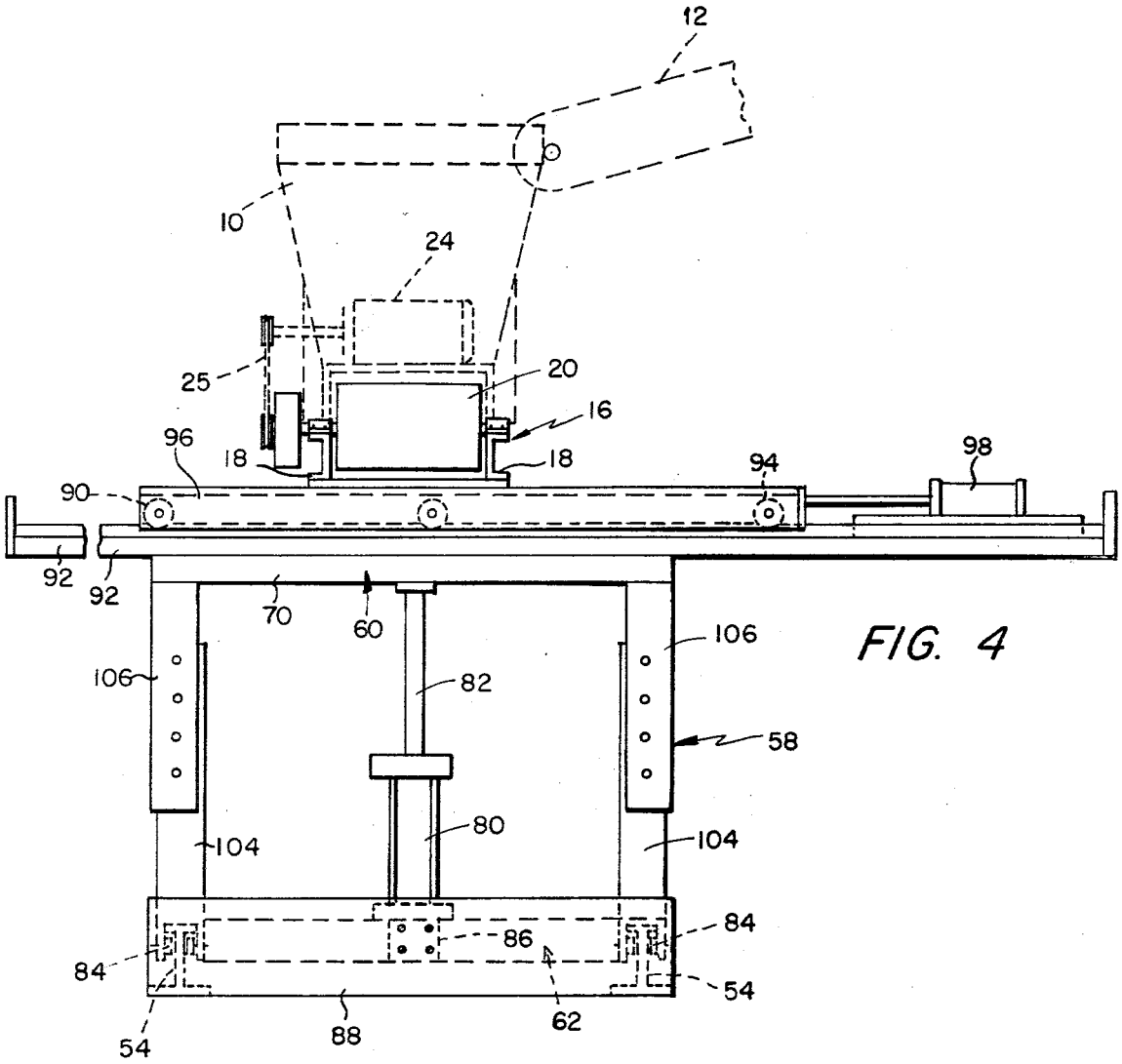
FIG. 4 is an end view of the structure shown in FIG. 3 showing a modified supporting carriage.

The carriage 58 is adapted to slide toward and away from the drum 26 on the rails 54 which interfit into the bottom channels of the I-beams 54 for this purpose, as shown in FIG. 4. Thrust bearings 84 are provided as shown to locate the members 64 on rails 54. To move the carriage 58 along the rails 54 there is provided a hydraulic or other device 86, similar to lifting device 80 which is mounted on a plate 88 fixed to the ends of rails 54 as shown in FIG. 3. The piston rod 90 of device 86 is attached to one of the cross members 66 of the lower frame 62 so that when the hydraulic device 86 is operated, rod 90 will move to push or pull the frame 62 and consequently the entire carriage 58 and parts of the apparatus thereon.

Fixed to the upper end of the carriage 58, as by welding to members 68 of the upper frame 60, are a pair of spaced perpendicularly extending rails 92 which are provided on their upper surfaces with a selected shape to accomodate rollers 94 which are carried by a pair of spaced parallel rails 96 which overlie and ride along the rails 92 in a direction laterally with respect to the drum's axis.

The hopper-and-conveyor-supporting frame 16 is fixedly mounted by its rails 18 on the rails 96 as by welding. Thus, by means of the rollers 94 the frames 96 and 16 may be moved laterally of the structure together with the hopper 10 and conveyor 20. Such lateral adjustment of the conveyor may be effected by any suitable means such as by a hydraulic device 90 which is fixed upon a supporting plate 100 carried by frame 96, the piston rod 102 of the hydraulic device 98 being attached to a rail 18 for moving the frame 16 as desired.

From the foregoing it will be understood that when the conveyor 20 is to be adjusted axially of the drum, device 80 will be operated to move the carriage 58 along the rails together with the structure thereon including the conveyor.

If the conveyor is to be moved vertically, device 80 is operated to move the frame 60 together with the structure thereon. If lateral adjustment of the conveyor is desired, device 98 will be operated to slide rails 18 and frame 96 along rails 92.

Figure 5:
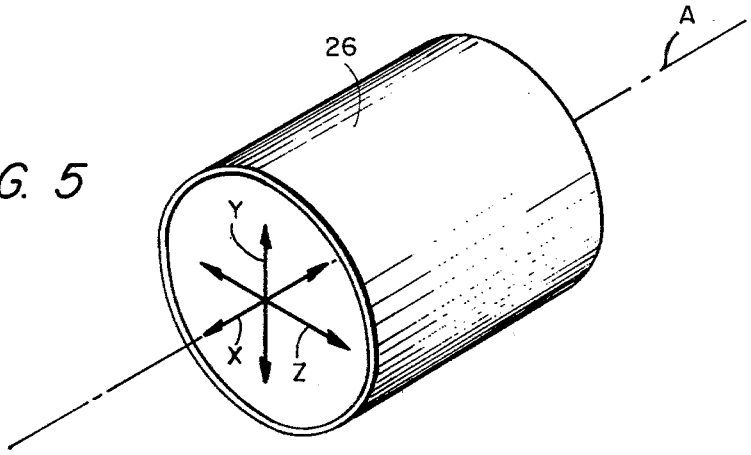
FIG. 5 is a diagram illustrating the x-y-z adjustability of the conveyor system of the invention.

Such x-y-z adjustment of the conveyor is diagrammatically illustrated in FIG. 5 wherein item 26 represents the drum, A is the axis, and x,y, and z respectively indicate axial, vertical and lateral directions of adjustment. It will be apparent that such adjustments may be preformed independently or simultaneously.

In the embodiment shown in FIG. 4, the scissor-type carriage has been replaced by four vertically extending corner posts 104 which are fixed to and extend upwardly from the lower frame 62, the posts 104 and slide vertically thereover. Thus, when the hydraulic device 80 is operated, the upper frame 60 will rise or fall together with posts 106. When the device is located at the desired level, the posts 106 and 104 are locked together by positioning pins within comating holes therein, in a well-known manner.

The foregoing description is believed to fully set forth sufficient details of the invention. However, it will be apparent that various modifications and changes may be made by those skilled in the art without departing from the spirit of the invention as expressed in the accompanying claims. For example, the described hydraulic actuating devices 80, 86, and 98 may be pneumatic devices or may be motor-operated, if desired. Therefore, it is to be understood that all matter shown and described is to be interpreted as illustrative and not in a limiting sense.

What is claimed is:

1. Adjustable conveyor-supporting apparatus comprising a conveyor operably extending parallel with a known axis, means for adjusting said conveyor with respect to said known axis, comprising the combination of a base comprised of a pair of spaced parallel base members located parallal with said axis, a first support comprising a base frame mounted on the base members and movable longitudinally thereon in a direction parallel to said axis, a second support comprising a pair of spaced parallel lateral rails mounted on said base frame and extending laterally in a direction perpendicular to said axis, said lateral rails being movable vertically with respect to said axis independent of said first support, and conveyor support means mounted on said lateral rails and movable thereon in a direction transverse to said axis, said conveyor being mounted on said conveyor support means and movable therewith and extending in a direction parallel to said axis.

2. Apparatus as set forth in claim 1 wherein said conveyor is a belt conveyor.

3. Apparatus as set forth in claim 1 wherein activating means are connected respectively to said first support, said lateral rails and said conveyor support means for individual movements thereof.

4. Apparatus as set forth in claim 3 wherein each of said activating means is a hydraulic system.

5. Apparatus as set forth in claim 1 wherein said second support comprises a scissor jack mounted at its lower end on the base frame, and a top frame mounted on its upper end, said lateral rails being fixed upon said top frame, and said top frame is movable vertically together with the lateral rails thereon.

6. Apparatus as set forth in claim 5 wherein said conveyor support means comprises a pair of spaced parallel third rails fixed to said lateral rails and extending in a direction parallel to said axis, and said conveyor is a belt conveyor supported by said third rails.

7. In a rotary drum classifier system, adjustable conveyor-supporting apparatus comprising a conveyor operably extending parallel with a known longitudinally axis of a rotary drum, means for adjusting said conveyor with respect to said axis comprising the combination of a base comprised of a pair of spaced parallel base members extending in a direction parallel to said axis, a first support comprising a base frame mounted on the base members and movable longitudinally thereon in a direction parallel to said axis, a second support comprising a pair of spaced parallel lateral rails mounted on said base frame and extending laterally in a direction perpendicular to said axis, said lateral rails being movable vertically with respect to said axis independent of said first support, and conveyor support means mounted on said lateral rails and movable thereon in a direction transverse to said axis, said conveyor being mounted on said support means and extending in a direction parallel to said axis and movable with said support means toward and away from one end of said drum.

8. Apparatus as set forth in claim 7 wherein said conveyor is a belt conveyor.

9. Apparatus as set forth in claim 7 wherein activating means are connected respectively to said first support, said lateral rails and said conveyor support means for individual movements thereof.

10. Apparatus as set forth in claim 9 wherein each of said activating means is a hydraulic system.

11. Apparatus as set forth in claim 7 wherein said second support comprises a scissor jack mounted at its lower end on the base frame, and a top frame mounted on its upper end, said lateral rails being fixed upon said top frame, and said top frame is movable vertically together with the lateral rails thereon.

12. Apparatus as set forth in claim 11 wherein said conveyor support means comprises a pair of spaced parallel third rails fixed to said lateral rails and extending in a direction parallel to said axis, and said conveyor is a belt conveyor supported by said third rails.

* * * * *